United States Patent [19]

Wisniewski

[11] Patent Number: 4,471,995

[45] Date of Patent: Sep. 18, 1984

[54] MOUNTING ARRANGEMENT FOR CANTILEVERED CHAIR ARM

[75] Inventor: Joseph M. Wisniewski, Marne, Mich.

[73] Assignee: Haworth, Inc., Holland, Mich.

[21] Appl. No.: 276,149

[22] Filed: Jun. 22, 1981

[51] Int. Cl.[3] ..... A47C 7/54

[52] U.S. Cl. ..... 297/411; 297/416

[58] Field of Search ..... 297/411, 416, 418, 160, 297/445, 415

[56] References Cited

U.S. PATENT DOCUMENTS

| | | | |
|---|---|---|---|
| D. 256,740 | 9/1980 | Acton . | |
| D. 256,741 | 9/1980 | Acton . | |
| D. 259,750 | 7/1981 | Buhk . | |
| 1,019,658 | 3/1912 | King | 297/415 |
| 2,328,243 | 8/1943 | Wood | 297/411 X |
| 2,669,288 | 2/1954 | Bargen | 297/160 X |
| 2,986,203 | 5/1961 | Close | 297/418 |
| 3,768,863 | 10/1973 | Jennings | 297/160 |
| 3,966,252 | 6/1976 | Albinson | 297/411 |
| 4,054,317 | 10/1977 | Stumpf | 297/416 X |
| 4,370,002 | 1/1983 | Koepke | 297/416 X |

FOREIGN PATENT DOCUMENTS

| | | | |
|---|---|---|---|
| 550583 | 12/1957 | Canada | 297/160 |

OTHER PUBLICATIONS

Steelcase brochure, "Concentrx Plus".

Steelcase brochure, "ConCentrx/454"-pp. 1-12.

*Primary Examiner*—Francis K. Zugel

*Attorney, Agent, or Firm*—Flynn, Thiel, Boutell & Tanis

[57] ABSTRACT

A chair wherein each cantilevered side arm terminates in a base portion positioned adjacent the rear edge of the seat. This base portion has an armlike mounting portion projecting forwardly therefrom into the interior of the seat. A U-shaped tubular frame is positioned within the interior of the seat so that the legs of the U-shaped frame project forwardly of the seat, and the bight of the U-shaped frame is positioned adjacent the rearward edge of the seat. The U-shaped frame is fixedly secured to a conventional chair-control frame as disposed interiorly of the seat. The rear portion of the U-shaped frame, including the bight and the elbows which join the bight to the legs, is inclined upwardly and rearwardly relative to the legs. The armlike mounting portions, as they project forwardly into the chair seat, are inclined downwardly at a similar angle. An upwardly opening, channel-like bracket is fixedly secured to each of the elbows. Each bracket fixedly and snugly receives therein the armlike mounting portion. The mounting portion, bracket and U-shaped frame are suitably fixedly connected by threaded fasteners.

16 Claims, 13 Drawing Figures

MOUNTING ARRANGEMENT FOR CANTILEVERED CHAIR ARM

FIELD OF THE INVENTION

This invention relates to a chair having cantilevered side arms and, in particular, to an improved arrangement for fixedly mounting the side arms to structure which is disposed internally of the chair seat.

BACKGROUND OF THE INVENTION

Office chairs having side arms have conventionally employed a multiple post arrangement for mounting the side arm. This multiple post arrangement has generally been secured to structure disposed internally of the seat, with the multiple posts projecting outwardly from the side of the seat and upwardly for attachment to the side arm adjacent the front and rear ends thereof. This multiple post arrangement was generally considered necessary in order to provide the side arm with adequate strength, particularly so as to be capable of withstanding the substantial downwardly and sidewardly directed loads as imposed on the arm during use of the chair. While this type of side arm arrangement does normally provide adequate strength and durability, nevertheless it also greatly restricts the esthetics and design characteristics of the chair.

In an attempt to provide a chair having a substantially different appearance, several office chairs have been designed utilizing cantilevered side arms. That is, the front end of the arm is not supported, so that the side arm is fixedly supported in its entirety solely by fixedly anchoring the rear end of the arm to suitable structure stationarily associated with the chair. This thus makes it extremely difficult to provide a strong and secure mounting of the cantilevered side arm, particularly since the side arm must be capable of withstanding minimum loading standards relative to downward vertical loads and outward sidewardly directed loads. Providing a proper structural mounting of the cantilevered arm so as to comply with, or exceed, the minimum loading requirements has thus presented a substantial obstacle and, in many instances, has required that the design (that is, the esthetics) of the arm be modified or that complex and costly structures be utilized.

Accordingly, this invention relates to an office chair having side arms, specifically cantilevered side arms, and the purpose of this invention is to provide an improved mounting arrangement for the cantilevered side arms so as to provide the side arms with substantial strength and rigidity whereby the side arms are capable of withstanding imposition thereon of external loads of substantial magnitude when imposed vertically downwardly and horizontally outwardly sidewardly thereof, while at the same time this improved mounting arrangement does not interfere with the ornamental and design characteristics of the cantilevered arms and of the overall chair. The improved arm mounting arrangement of this invention also enables the cantilevered arms and mounting structure to be manufactured and assembled with minimal complexities so as to permit efficient and economical manufacture.

In the chair of this invention, each cantilevered side arm includes an arm rest portion which at its rearward end terminates in an intermediate arm portion which is of compound curvature in that it projects rearwardly, curves downwardly, and also curves inwardly so as to terminate in a base portion which is positioned adjacent the rear edge of the seat. This base portion has an armlike mounting portion integral therewith and projecting forwardly therefrom into the interior of the seat. This armlike mounting portion is cantilevered from the base portion. The mounting structure for the cantilevered arms includes a U-shaped tubular frame which is positioned within the interior of the seat so that the legs of the U-shaped frame project forwardly of the seat, and the bight of the U-shaped frame is positioned adjacent the rearward edge of the seat. The legs of the U-shaped frame are fixedly secured, as by screws, to the conventional chair-control frame as disposed interiorly of the seat. The rear portion of the U-shaped frame, including the bight and the curved elbows which join the bight to the legs, is disposed within a plane which is inclined upwardly and rearwardly relative to the legs, such as at an angle of approximately 30°. The armlike mounting portions, as they project forwardly into the chair seat, are also inclined downwardly at a similar angle. An upwardly opening, channel-like bracket is fixedly secured to each of the elbows, and is inclined at the same angle as the elbow. Each bracket fixedly and snugly receives therein the armlike mounting portion. The mounting portion, bracket and U-shaped frame are suitably fixedly connected by threaded fasteners.

The cantilevered arm mounting arrangement of this invention is such as to be cost effective, relative to both labor and materials. Further, this arrangement is capable of meeting industry standards by means of a structure which, when subjected to minimal loading requirements, does not provide any plastic yield or permanent deformation, while at the same time utilizing a simple connecting structure which requires only minimal tooling and which does not interfere with the shape or size or comfort of the chair seat.

Other objects and purposes of the invention will be apparent to persons familiar with chairs of this type upon reading the following specification and inspecting the accompanying drawings.

Figure 10:
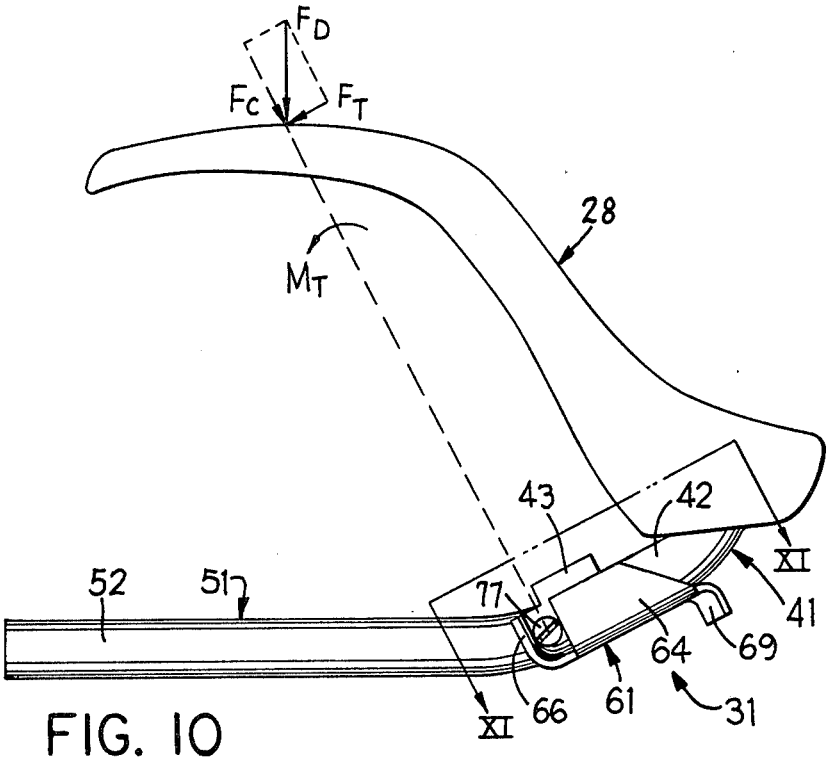
FIG. 10 is a side view similar to FIG. 7 but showing the attachment of the cantilevered arm to the mounting structure.
Figure 9:
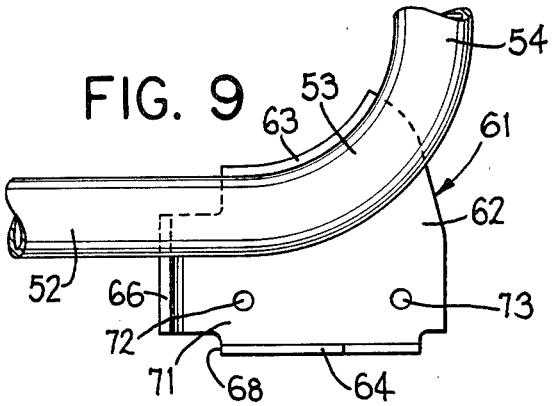

Certain terminology will be used in the following description for convenience in reference only and will other force component $F_T$ is resisted by the bracket front flange 66, and creates a moment $M_T$ which tends to tilt the arm 28 in a counterclockwise direction as illustrated in FIG. 10, so that the arm thus tends to rock about a pivot defined adjacent the lower front edge of the mounting portion 41. This moment $M_T$ is hence primarily resisted by the rear screw 79, which screw has imposed thereon a tension force which, acting through a lever arm equal to the distance between the screw and the forward edge of the mounting portion 41, hence resists the twisting moment $M_T$. Thus, this connecting structure, and specifically the fact that the bracket 61 and mounting portion 41 extend upwardly at the angle Θ, thus provides a very rigid and strong mounting of the cantilevered arm so that it can easily withstand the direct downward vertical force $F_D$ while subjecting the mounting structure to forces of reasonable magnitude.

Figure 1:
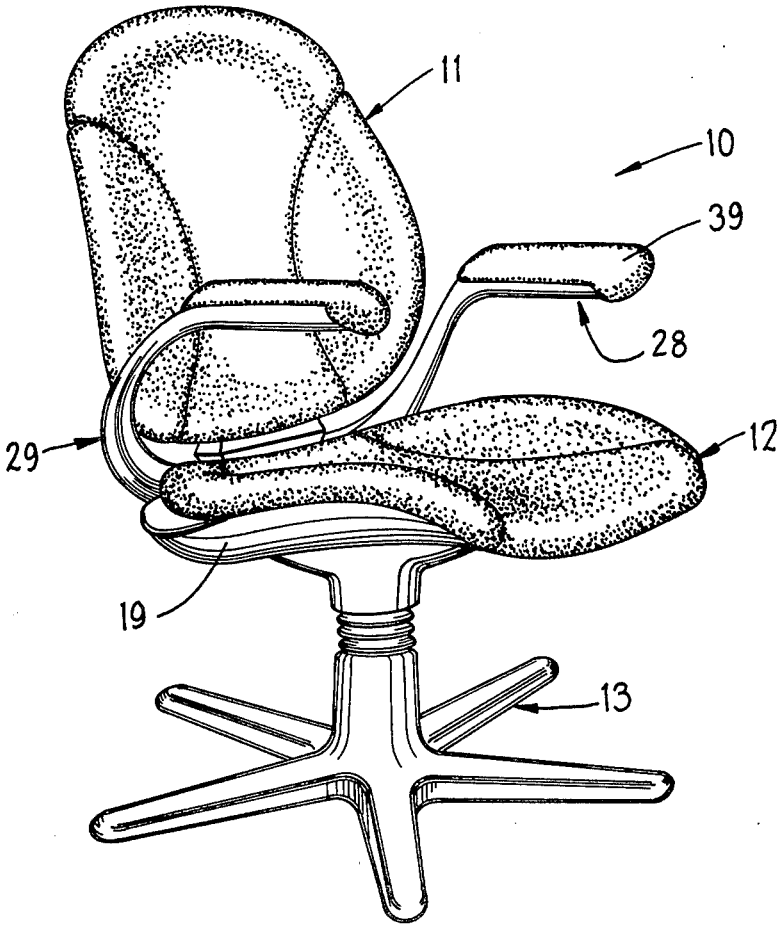
FIG. 1 is a perspective view of a chair employing cantilevered side arms according to this invention.
Figure 2:
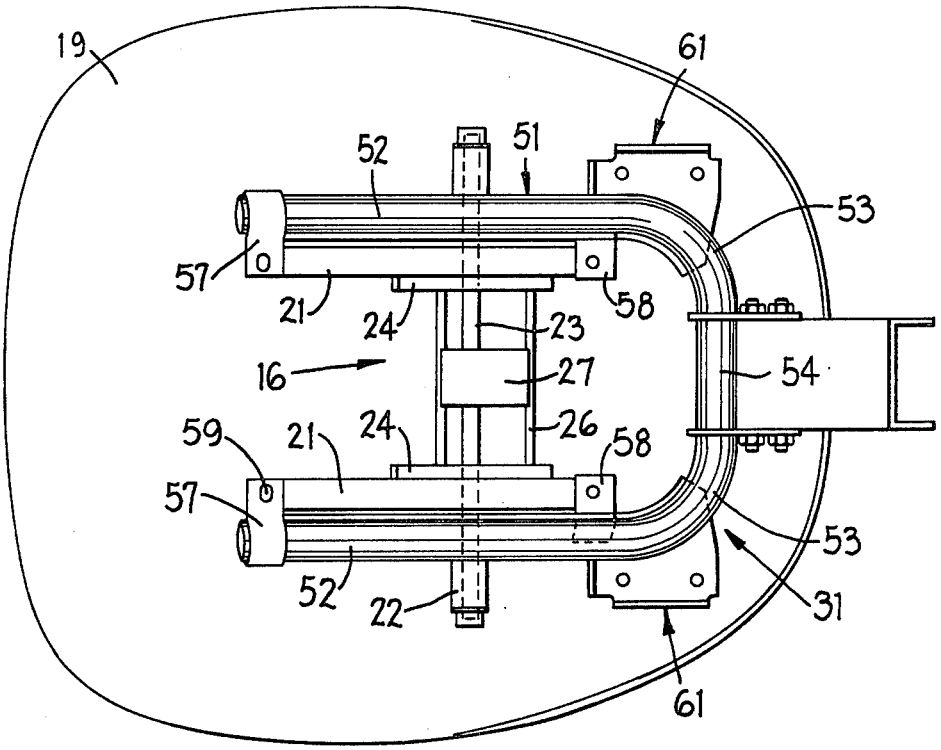
FIG. 2 is a plan view of the chair seat, with the cushion and internal shell removed, so as to illustrate the attachment of the arm mounting structure to the chair-control frame.
Figure 3:
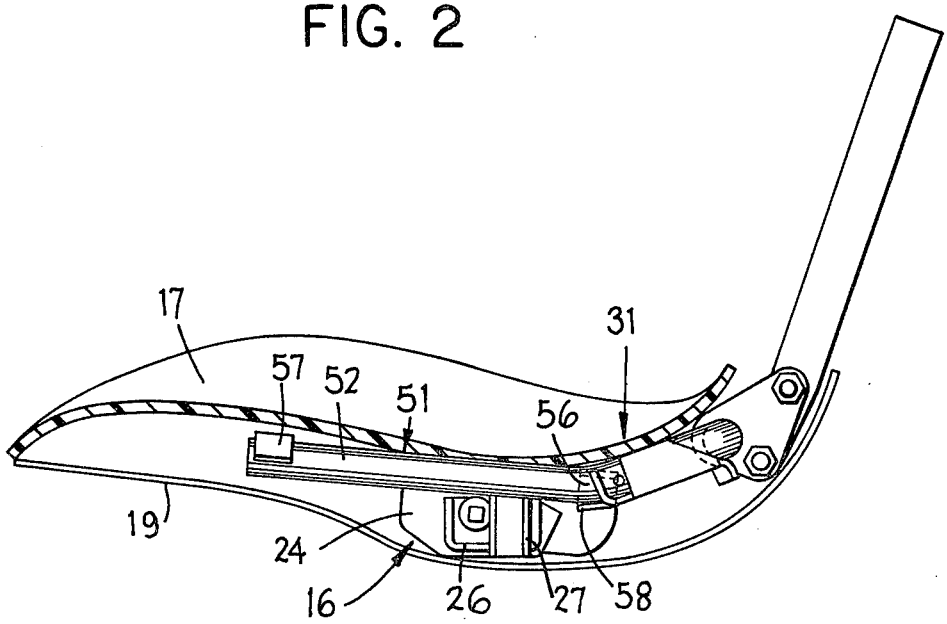
FIG. 3 is a side view of the structure illustrated in FIG. 2 but showing the inner shell in cross section.
Figure 4:
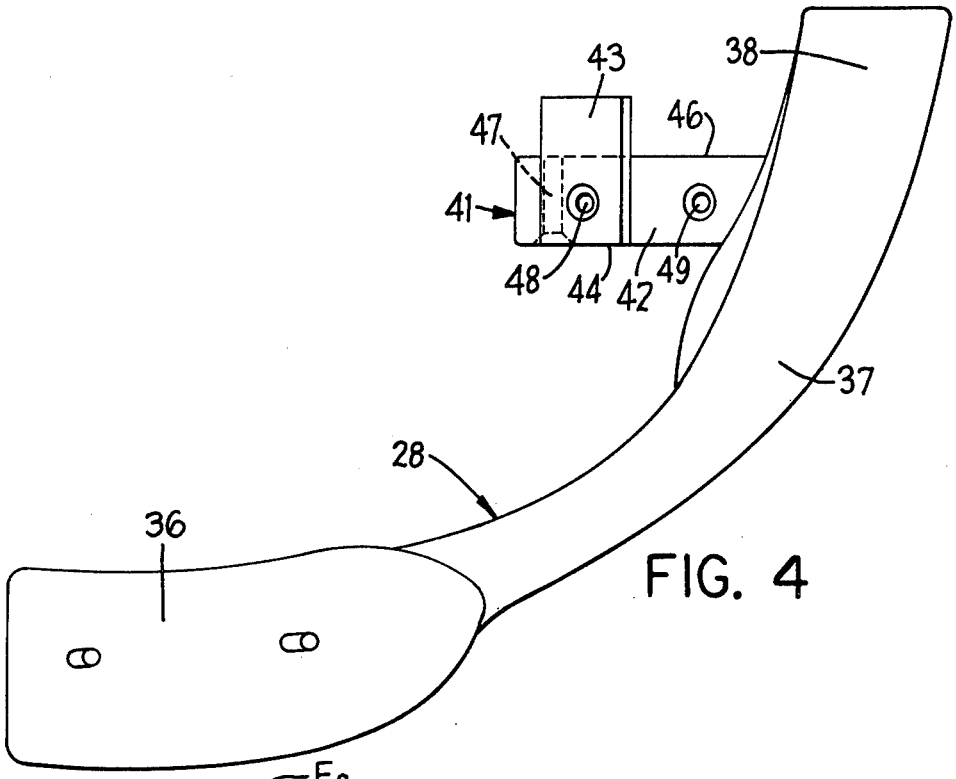
FIGS. 4, 5 and 6 are respectively top, side and rear views of the cantilevered arm.
Figure 5:
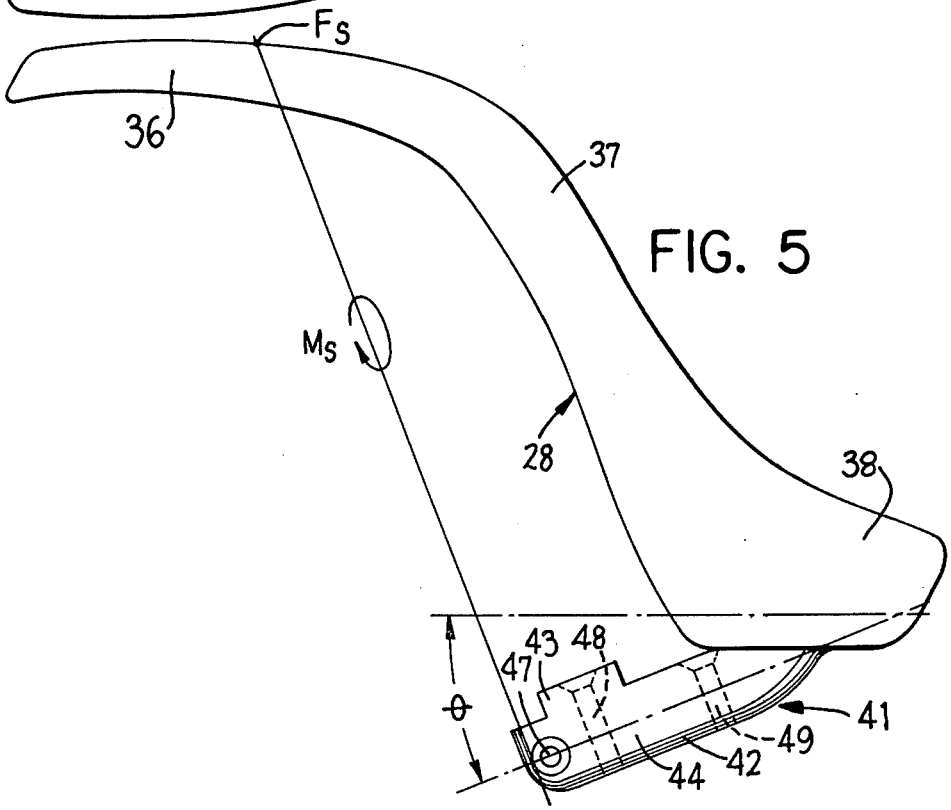
Figure 6:
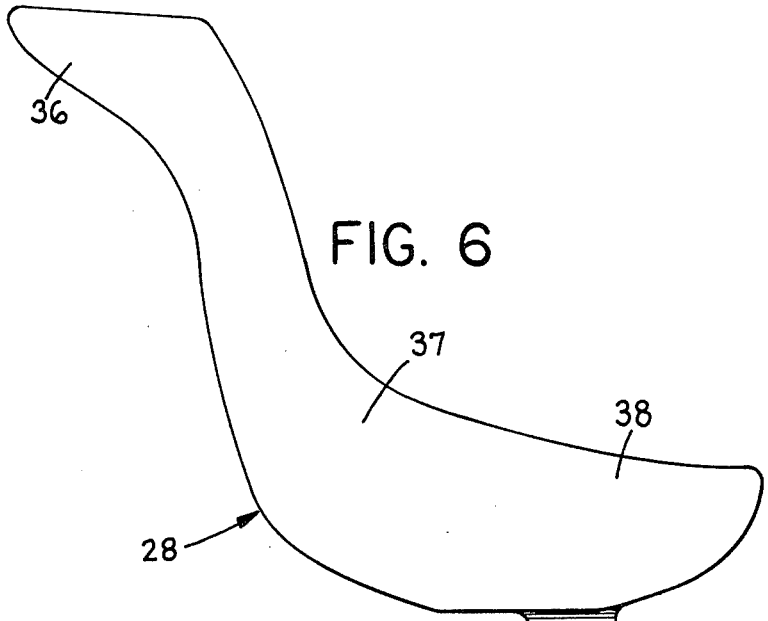
Figure 7:
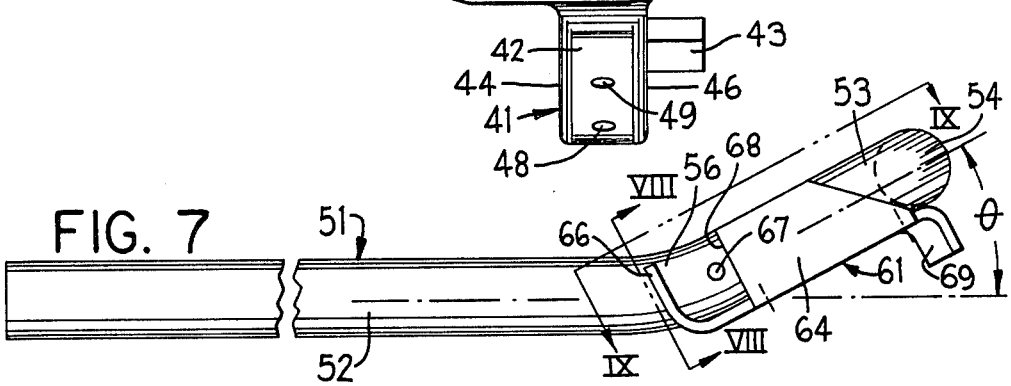
FIG. 7 is a side view of the arm mounting structure which is disposed interiorly of the chair seat.
Figure 11:
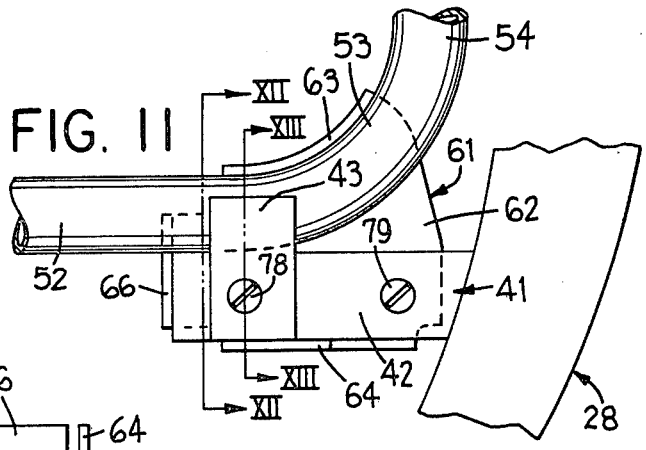
FIG. 11 corresponds to FIG. 9 but shows the arm secured to the bracket, and is hence taken substantially along line XI—XI in FIG. 10.
Figure 8:
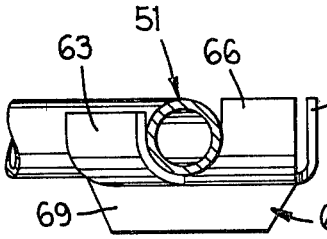
FIGS. 8 and 9 are fragmentary views taken substantially along lines VIII—VIII and IX—IX, respectively, as appearing in FIG. 7.
Figure 12:
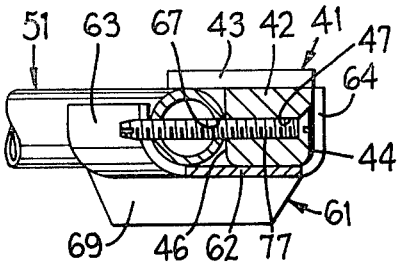
FIGS. 12 and 13 are sectional views taken substantially along lines XII—XII and XIII—XIII, respectively, as appearing in FIG. 11.
Figure 13:
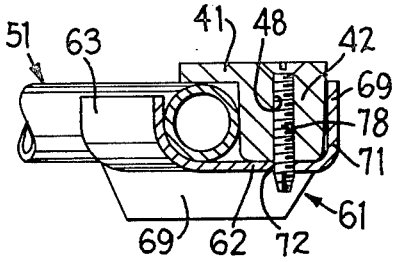

When a horizontally directed side force is imposed outwardly against the arm, which force would be directed perpendicularly outwardly in FIG. 5 and is represented by the point $F_S$, this force is directly imposed against the outer bracket flange 64 and is also resisted by tension imposed on the sidewardly directed screw 77. This force $F_S$, however, also creates a torsional moment $M_S$ which tends to twist the mounting element 42 sidewardly within the bracket 61. This tendency for the mounting element 42 to twist, which occurs clockwise in FIGS. 12 and 13, is effectively resisted by the fact that this element 42 is tightly fit between the flange 64 and the tube 51, and thus a reactive moment is created by the tube 51 and flange 64 acting against the opposite sides of the mounting element 42 for resisting the moment $M_S$.

The overall strength and rigidity provided by this mounting arrangement for the cantilevered arms 28 and 29 is accomplished by the provision of the simple U-shaped stretcher tube 51 inasmuch as the cantilevered arms have their mounting portions 41 disposed adjacent their rearward ends, with these mounting portions being directly fixedly attached to the brackets 61, which brackets are rigidly attached to the elbows 53 of the stretcher tube. These elbows 53 in turn are disposed adjacent the rear of the seat assembly, and the elbows themselves are directly and rigidly joined together by the intermediate tubular bight 54 which is also disposed adjacent the rear edge of the seat assembly. Hence, this bight 54 and associated elbows 53 effectively function as an integral rigid extension between the inner rear ends of the arms 28 and 29. Thus, even though this invention possesses the advantage of permitting the arms 28 and 29 to be constructed as separate individual elements, nevertheless the tubular bight 54 which is rigidly joined substantially directly between the rear inner ends of the arms 28–29 effectively permits the arms 28–29 to function as if they were formed as a single U-shaped structure, whereby the present invention thus possesses the advantages of such a single U-shaped arm structure, but not the obvious disadvantages thereof.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a seat assembly supported on a pedestal-type base, the seat assembly including a support structure positioned interiorly thereof, and a pair of cantilevered side arms positioned adjacent the opposite side edges of the seat assembly in upwardly spaced relationship therewith, comprising the improvement wherein:

each said side arm is formed as a separate member and includes an arm rest portion at the front end thereof and a base portion at the rear end thereof, said base portion being positioned adjacent the rear edge of the seat assembly;

said arm also including an elongated armlike mounting portion fixed to said base portion and projecting forwardly therefrom into the interior of said seat assembly; and mounting means fixed to said support structure and disposed within said seat assembly for fixedly but releasably supporting said cantilevered side arms;

said mounting means including a frontwardly opening U-shaped frame member fixed to said support structure and having a bight portion disposed adjacent the rear edge of said seat assembly, said bight portion including a pair of sidewardly spaced elbows rigidly joined together by a substantially horizontally extending intermediate portion which extends sidewardly of the seat assembly, each said elbow having bracket means fixed thereto;

said armlike mounting portion being fixedly but removably attached to one of said bracket means; and said U-shaped frame member including a pair of elongated and substantially straight legs which project toward the front edge of the seat assembly in substantially parallel relationship, said legs at their rearward ends being rigidly joined together by said bight portion, said legs extending approximately horizontally, said bight portion being bent upwardly relative to said legs as it projects rearwardly, and the mounting portion as fixed to each said arm being sloped downwardly as it projects forwardly from the base portion.

2. A chair according to claim 1, wherein the elbows are rather smoothly bent through a gradual curvature of approximately 90° for joining the straight leg to the intermediate portion, each said elbow having a said bracket means fixed thereto and projecting sidewardly thereof, said bracket means cooperating with said elbow for defining an elongated rearwardly opening channel which projects toward the front of the seat assembly, and threaded fastener means for fixedly and rigidly connecting said mounting portion to said bracket means.

3. A chair according to claim 1, wherein said bracket means includes a base wall which projects sidewardly from the underside of the elbow and slopes upwardly and rearwardly at the same angle as the bight portion, said bracket means also including an upwardly projecting side flange fixed to and projecting upwardly from the outer side edge of the base wall, said mounting portion being snugly positioned within the bracket means so that the opposite sides of the mounting portion are engaged with and between the elbow and the upwardly projecting side flange, and at least one said threaded fastener means projecting downwardly through the mounting portion adjacent the rearward end thereof for fixedly connecting the mounting portion to the base wall of the bracket means, and a second said threaded fastener means projecting downwardly through the mounting portion adjacent the forward end thereof for directly fixedly connecting the mounting portion to the base wall.

4. A chair according to claim 3, wherein the bracket means includes a front flange which is fixed to and projects upwardly from the front edge of the base wall, said mounting portion having the free end thereof positioned adjacent said front flange.

5. A chair according to claim 1, wherein the centerlines of the straight legs define a first plane which is approximately horizontal, and wherein the centerline of the bight portion defines a second plane which projects rearwardly and slopes upwardly relative to the horizontal at an angle which is at least approximately 25° and which does not significantly exceed 45°.

6. A chair according to claim 1, wherein said armlike mounting portion includes an elongated blocklike arm member which projects forwardly from said base portion in cantilevered relationship therewith, said armlike mounting portion also including a top flange portion which is integrally fixed to the blocklike arm member adjacent the free end thereof and projects sidewardly inwardly therefrom, whereby the armlike mounting portion has a substantially L-shaped configuration, said top flange portion being adapted to overlie and bear against said elbow.

7. A chair according to claim 3, wherein the centerlines of the straight legs define a first plane which is approximately horizontal, and wherein the centerline of the bight portion defines a second plane which projects rearwardly and slopes upwardly relative to the horizontal at an angle which is at least approximately 25° and which does not significantly exceed 45°.

8. A chair according to claim 1, wherein said U-shaped frame member is formed from an elongated tube.

9. A chair according to claim 2, wherein said U-shaped frame member is formed from an elongated tube.

10. In a chair having a seat assembly supported on a base, the seat assembly including a support structure positioned interiorly thereof, and a pair of cantilevered side arms positioned adjacent the opposite side edges of the seat assembly in upwardly spaced relationship therewith, comprising the improvement wherein:

each said side arm is formed as a separate member and includes an elongated arm rest portion at the front free end thereof, a base portion at the rear free end thereof, and a downwardly and sidewardly curved intermediate portion fixedly joined between said arm rest and base portions, said base portion being positioned downwardly, rearwardly and inwardly from said arm rest portion so as to be disposed adjacent the rear edge of the seat assembly;

said side arm also including a cantilevered armlike mounting portion fixed to said base portion and projecting forwardly therefrom into the interior of said seat assembly; and mounting means fixed to said support structure and disposed within said seat assembly for fixedly but releasably supporting said cantilevered armlike mounting portions, said mounting means including a pair of bracket means disposed in sidewardly spaced relation within the interior of said seat assembly in the vicinity of the rear edge thereof, each said armlike mounting portion being fixedly but removably attached to one of said bracket means;

each said bracket means comprising a rigid bracket defining therein a rearwardly extending channel which snugly accommodates said armlike mounting portion therein, and removable fastener means connected between said armlike mounting portion and said bracket for fixedly connecting same together.

11. A chair according to claim 10, wherein said pair of bracket means are rigidly attached together by an elongate rigid intermediate tubular member which extends between the bracket means and is disposed closely adjacent the rear edge of the seat assembly.

12. A chair according to claim 10, wherein said mounting means includes a U-shaped tubular frame member positioned within the interior of said seat assembly and fixedly secured to said support structure, said frame member having substantially parallel elongated side elements which are spaced sidewardly apart and are joined together by a bight portion which extends transversely therebetween, and said pair of bracket means being fixedly secured to said U-shaped frame member adjacent the opposite sides thereof.

13. A chair according to claim 10, wherein said removable fastener means includes at least two threaded fasteners which rigidly connect each said armlike mounting portion to its respective said bracket, said fasteners extending predominantly in a vertical direction and being spaced apart in the rearward direction of the seat assembly.

14. A chair according to claim 12, wherein the parallel elongated side elements are rigidly joined adjacent their front ends thereof to said support structure, and wherein said bight portion is disposed closely adjacent the rear edge of the seat assembly.

15. In a chair having a seat assembly supported on a pedestal-type base, the seat assembly including an inner seat shell positioned interiorly therein, the seat assembly also including a support structure positioned interiorly thereof beneath said inner shell, and a pair of cantilevered side arms positioned adjacent the opposite side edges of the seat assembly in upwardly spaced relationship therewith, comprising the improvement wherein:

each said side arm is formed as a separate member and includes an arm rest portion at the front end thereof and a base portion at the rear end thereof;

said arm also including an elongated armlike mounting portion fixed to said base portion and projecting therefrom into the interior of said seat assembly; and mounting means fixed to said support structure and disposed within said seat assembly for fixedly but releasably supporting said cantilevered arms;

said mounting means including a one-piece U-shaped tubular frame member positioned within the interior of said seat assembly below said inner shell and fixedly secured to said support structure, said frame member having substantially parallel elongated side elements which are spaced sidewardly apart and are joined together by a bight portion which extends transversely therebetween, said side elements being rigidly secured to said support strucure, and a pair of channellike bracket means fixedly secured to said U-shaped frame member adjacent the opposite sides thereof; and each said armlike mounting portion being positioned in and fixedly but removably attached to a respective one of said channellike bracket means.

16. A chair according to claim 15, wherein said channellike bracket means open rearwardly, and removable fastener means connected between said armlike mounting portion and said bracket means for fixedly connecting same together, said removable fastener means including a pair of threaded fasteners which are rearwardly spaced apart and project substantially vertically for joining said armlike mounting portion and the respective said bracket means together.

* * * * *

United States Patent [19]

Primeau

[11] Patent Number: 4,471,996

[45] Date of Patent: Sep. 18, 1984

[54] WHEELBARROW WITH PIVOTED HANDLES

[76] Inventor: Mario Primeau, 8710 Marjolaine, Ville St. Leonard, Quebec, Canada, H1R 2H6

[21] Appl. No.: 417,860

[22] Filed: Sep. 14, 1982

[30] Foreign Application Priority Data

Oct. 2, 1981 [CA] Canada ..... 387145

[51] Int. Cl.[3] ..... B62B 1/20

[52] U.S. Cl. ..... 298/3; 280/47.31; 280/653

[58] Field of Search ..... 298/2, 3, 5, 6; 280/47.3, 47.31, 653, 47.36, 47.37 R

[56] References Cited

U.S. PATENT DOCUMENTS

| | | | |
|---|---|---|---|
| 1,255,128 | 2/1918 | Bayley | 280/47.31 X |
| 2,797,125 | 6/1957 | Vogler | 280/47.31 X |
| 2,938,734 | 5/1960 | Guimond | 280/47.37 R X |
| 2,967,058 | 1/1961 | Hoffmann, Jr. | 280/47.31 X |
| 3,258,275 | 6/1966 | Schaeter et al. | 280/47.37 R X |
| 4,412,689 | 11/1983 | Lee | 280/47.37 R X |

FOREIGN PATENT DOCUMENTS

| | | | |
|---|---|---|---|
| 711297 | 6/1954 | United Kingdom | 280/47.31 |

*Primary Examiner*—Robert J. Spar

*Assistant Examiner*—Janice Krizek

*Attorney, Agent, or Firm*—Alan Swabey; Robert Mitchell; Guy Houle

[57] ABSTRACT

A load-carrying device comprises a frame adapted to support a load to be carried, and having front and rear end portions. A wheel is rotatably mounted to the frame and positioned at the front end portion for supporting same. The device of the invention further comprises elongated handle means pivotally connected to the rear end portion and frame support means connected to and displaceable with the handle means, the handle means being pivotally movable between a first position whereat the handle means extends rearwardly of the frame for carrying the load with the frame support means being disposed to support the rear end portion, and a second position whereat the frame support means is retracted from its supporting position. A releasable locking means is also provided for interlocking the handle means with the frame in the first position. Pivotal movement of the handle means from the first to the second position causes the frame to be displaced from a raised position above ground to a lowered position adjacent the ground and the rear end portion of the frame to be disposed substantially on ground level, thereby enabling the load to be loaded or unloaded at ground level.

24 Claims, 14 Drawing Figures

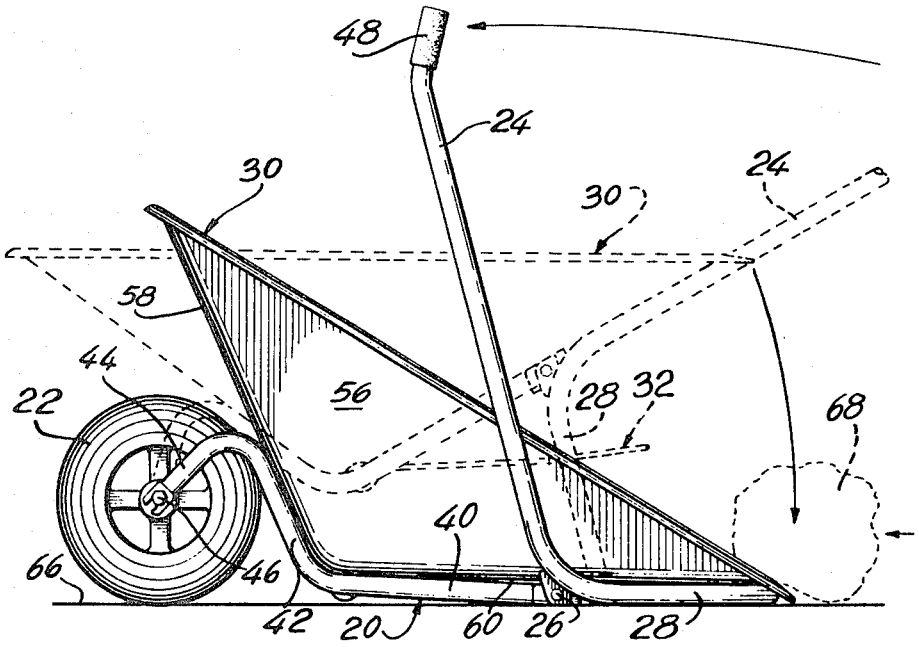

UNITED STATES PATENT AND TRADEMARK OFFICE

CERTIFICATE OF CORRECTION

PATENT NO. : 4 471 995

DATED : September 18, 1984

INVENTOR(S) : Joseph M. WISNIEWSKI

It is certified that error appears in the above-identified patent and that said Letters Patent is hereby corrected as shown below:

Column 9, line 26; change "claim 3" to ---claim 2---.

Signed and Sealed this

*Sixth* Day of *August 1985*

[SEAL]

*Attest:*

DONALD J. QUIGG

*Attesting Officer* *Acting Commissioner of Patents and Trademarks*